US007421856B2

(12) United States Patent
Chakravarthy et al.

(10) Patent No.: US 7,421,856 B2
(45) Date of Patent: Sep. 9, 2008

(54) CRYOGENIC AIR SEPARATION WITH ONCE-THROUGH MAIN CONDENSER

(75) Inventors: Vijayaraghavan Srinivasan Chakravarthy, Williamsville, NY (US); Richard John Jibb, Amherst, NY (US); Michael James Lockett, Grand Island, NY (US); John Henri Royal, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 424 days.

(21) Appl. No.: 11/154,630

(22) Filed: Jun. 17, 2005

(65) Prior Publication Data

US 2006/0283208 A1 Dec. 21, 2006

(51) Int. Cl.
*F25J 3/00* (2006.01)

(52) U.S. Cl. ..... 62/643; 62/903

(58) Field of Classification Search ..... 62/643, 62/903

See application file for complete search history.

(56) References Cited

U.S. PATENT DOCUMENTS

| | | | | |
|---|---|---|---|---|
| 4,436,146 A | | 3/1984 | Smolarek | 165/111 |
| 5,014,773 A | | 5/1991 | Beduz et al. | 165/115 |
| 5,122,174 A | | 6/1992 | Sunder et al. | 62/24 |
| 5,386,691 A | * | 2/1995 | Bonaquist et al. | 62/646 |
| 5,410,885 A | * | 5/1995 | Smolarek et al. | 62/646 |
| 5,438,836 A | | 8/1995 | Srinivasan et al. | 62/36 |
| 5,537,840 A | | 7/1996 | Srinivasan et al. | 62/643 |
| 5,699,671 A | * | 12/1997 | Lockett et al. | 62/63 |
| 5,724,834 A | | 3/1998 | Srinivasan et al. | 62/643 |
| 6,393,866 B1 | | 5/2002 | Srinivasan et al. | 62/643 |
| 6,695,043 B1 | | 2/2004 | Wagner et al. | 165/115 |
| 2004/0050538 A1 | | 3/2004 | Sunder et al. | 165/133 |
| 2007/0028649 A1 | * | 2/2007 | Chakravarthy et al. | 62/643 |

* cited by examiner

*Primary Examiner*—William C Doerrier
(74) *Attorney, Agent, or Firm*—David M. Rosenblum

(57) ABSTRACT

A cryogenic air separation system wherein nitrogen vapor from a higher pressure column and oxygen liquid from a lower pressure column each pass down through a once-through main condenser in heat exchange relation and some but not all of the oxygen liquid is vaporized such that the oxygen liquid and vapor exit the condenser in a liquid to vapor mass flowrate ratio within the range of from 0.05 to 0.5 whereby the need for a recirculation pump to ensure avoidance of oxygen boiling to dryness is eliminated.

7 Claims, 1 Drawing Sheet

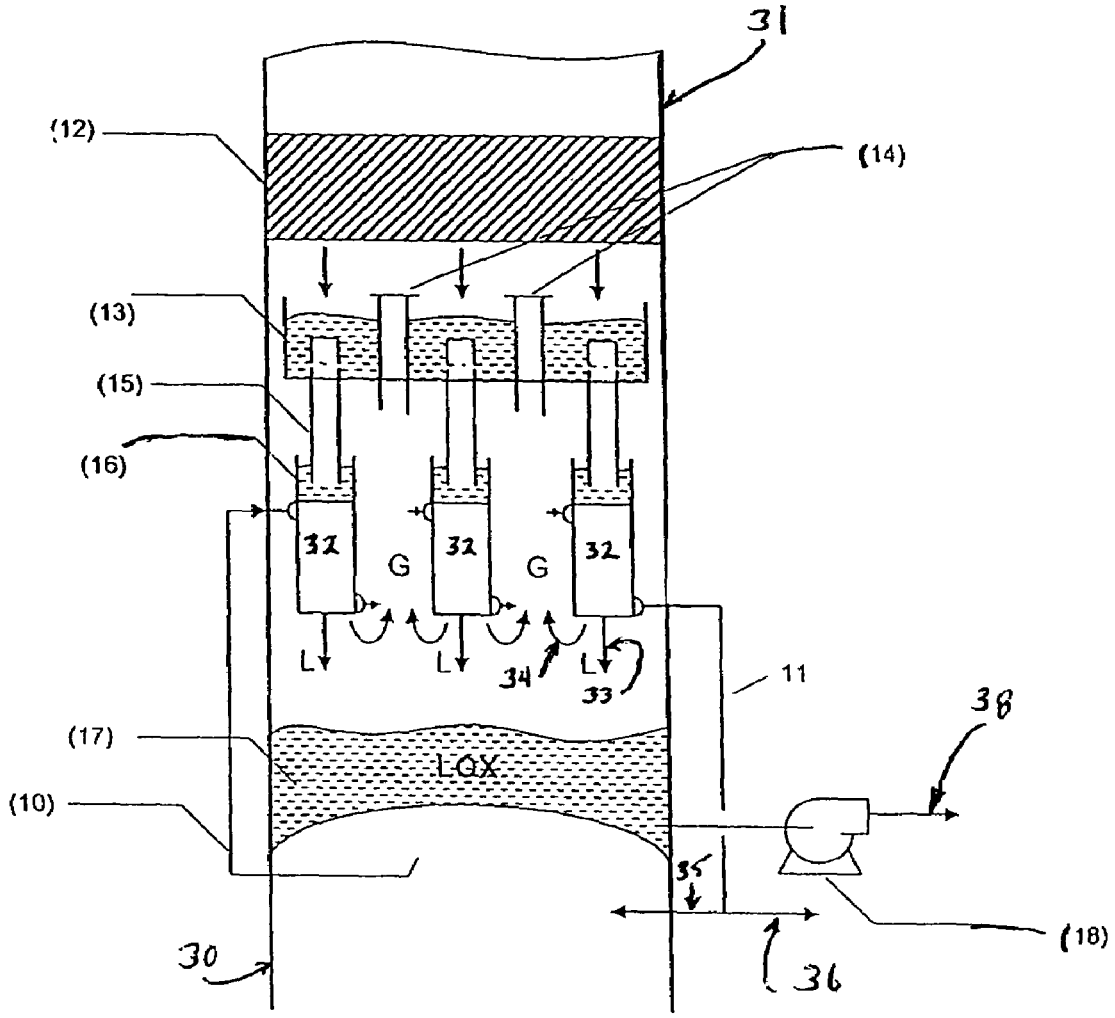
31
(12)
(14)
(13)
(15)
(16)
32
32
32
G
G
L
L
L
34
33
11
38
(17)
LOX
(10)
35
(18)
30
36

CRYOGENIC AIR SEPARATION WITH ONCE-THROUGH MAIN CONDENSER

TECHNICAL FIELD

This invention relates generally to cryogenic air separation and, more particularly, to cryogenic air separation employing a double column.

BACKGROUND ART

Cryogenic air separation systems which employ downflow main condensers typically employ recirculation pumps to ensure adequate wettability of boiling passages during normal as well as part-load operation. Liquid recirculation from the column sump through the boiling passages results in good heat transfer performance as well as enabling satisfaction of the safety criteria of preventing oxygen boiling to dryness. However, recirculation pumps increase cost, reduce reliability and reduce efficiency of the system due to the power penalty incurred to run the pump.

SUMMARY OF THE INVENTION

A method for operating a cryogenic air separation plant having a higher pressure column and a lower pressure column comprising passing nitrogen vapor from the higher pressure column to the upper portion of a once-through main condenser, flowing oxygen liquid from the separation section of the lower pressure column to the upper portion of the once-through main condenser, passing the nitrogen vapor and the oxygen liquid down the once-through main condenser in heat exchange relation wherein at least some but not all of the downflowing oxygen liquid is vaporized, and withdrawing both oxygen vapor and oxygen liquid from the once-through main condenser in a liquid to vapor mass flowrate ratio within the range of from 0.05 to 0.5.

As used herein, the term "separation section" means a section of a column containing trays and/or packing and situated above the main condenser.

As used herein, the term "enhanced boiling surface" means a special surface geometry that provides higher heat-transfer per unit surface area than does a plain surface.

As used herein, the term "high flux boiling surface" means an enhanced boiling surface characterized by a thin metallic film possessing high porosity and large interstitial surface area which is metallurgically bonded to a metal substrate by means such as sintering of a metallic powder coating.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

BRIEF DESCRIPTION OF THE DRAWING

The sole FIGURE is a simplified representational schematic diagram of one preferred embodiment of the cryogenic air separation operating method of this invention.

DETAILED DESCRIPTION

In the practice of cryogenic air separation with downflow main condensers, it is necessary that the oxygen liquid flowing down the condenser not be completely vaporized so as to avoid the inefficient and dangerous boiling to dryness condition. To achieve this wetting, a liquid to vapor mass flowrate ratio (L/V) of greater than 0.5 and preferably from 1 to 4 is necessary for the fluid leaving the vaporizing passages of the condenser, and this criteria generally requires the recirculation of some liquid from the sump of the column to the boiling passages of the downflow main condenser.

The invention enables the operation of a downflow main condenser in a cryogenic air separation plant with an L/V within the range of from 0.05 to 0.5. During normal operation the reduced L/V requirement eliminates the need to recirculate liquid from the column sump to the vaporizing passages of the downflow main condenser. The once-through main condenser of this invention processes oxygen liquid from only the separation section of the column and employs boiling passages having an enhanced boiling surface, preferably a high flux boiling surface.

The invention will be described more fully with reference to the Drawing. Referring now to the FIGURE there is shown a partial schematic of a double column cryogenic air separation plant, having a higher pressure column 30 and a lower pressure column 31, and showing the placement of once-through main condensers 32, also referred to as condenser/reboilers, inside the lower pressure column. The main condenser/reboilers thermally link the higher pressure and lower pressure columns. Nitrogen vapor, at a pressure generally within the range of from 45 to 300 pounds per square inch absolute (psia), is passed in line 10 from higher pressure column 30 to the upper portion of the once-through main condenser or condensers wherein the nitrogen vapor exchanges heat with oxygen liquid as both fluids flow down through the once-through main condenser(s). The oxygen liquid, which is at a pressure generally within the range of from 1 to 100 pounds per square inch gauge (psig) is partially vaporized and the resulting oxygen vapor and remaining oxygen liquid are withdrawn from the once-through main condensers(s) as shown by flow arrows 34 and 33 respectively. The nitrogen vapor is completely condensed by the downflow passage through the once-through main condenser and the resulting nitrogen liquid is withdrawn from the once-through main condenser in line 11 and passed in lines 35 and 36 respectively as reflux into the higher pressure and lower pressure columns.

In the lower pressure column 31, oxygen liquid descending the column through packing 12 or trays (not shown) is collected in collector/distributor 13. Open risers 14 extend up from the floor of the collector box for the oxygen vapor generated in the main condenser to flow up through the column. Oxygen liquid from the collector flows through distributor pipe 15 and collects in the distributor section 16 of the individual modules. The oxygen liquid from the flow distributor section flows through the individual tubes or heat transfer passages where it is partially vaporized. These passages have enhanced boiling surfaces which significantly increases the ability of the liquid to wet the surface of the boiling side and reduces the amount of liquid flow needed to achieve wetting. The unvaporized liquid 17 collects at the bottom of the column and is withdrawn from the column as a product. The product boiler pump 18 is used to raise the pressure of oxygen to the required product pressure. The ratio of liquid to vapor mass flowrate (L/V) at the exit of the main condenser tubes or vaporizing passages ranges from 0.05 to 0.5, and is preferably within the range of from 0.2 to 0.4.

It is essential to maintain a minimum liquid flow rate over the boiling surfaces to ensure adequate wetting for the following reasons:

1. To prevent breakdown of the liquid film so that the heat transfer surface area is effectively utilized in forced convective evaporative or boiling heat transfer. Unwetted regions lose their effectiveness in terms of heat transfer to the vaporizing stream.
2. To ensure that the maximum contaminant content, especially hydrocarbons, in the unvaporized liquid oxygen does not reach dangerous levels. The hydrocarbon concentration in the liquid oxygen increases progressively as the oxygen vaporizes in the heat transfer passages.
3. To minimize fouling (deposition of solid contaminants such as nitrous oxide, carbon dioxide, etc.) by ensuring adequate wetting of the boiling surfaces. Fouling is also minimized by keeping the concentration of the contaminants in the liquid well below their solubility limits.

For the reasons given above, the specified liquid flow rate must be sufficient to provide a stable liquid film on the boiling surface. It should also be sufficient to ensure adequate wetting, i.e. that liquid is spread evenly across the boiling surface in each individual channel. Whether or not the liquid flow is sufficient to keep the boiling surfaces adequately wetted is a key design consideration. The flow rate for adequate wetting (defined as mass flow per unit width of the heat transfer surface in the flow direction) depends on:

1. The type of surface (enhanced v. plain surface). Enhanced surfaces wet better than plain surfaces due to the capillary effects that help spread the liquid;
2. Geometry of the flow passage (circular v. non-circular). In a non-circular passage the film thickness is non-uniform. Surface tension forces draw the liquid into the corners. Therefore, the area of the surface where the film thickness is less than the average tends to dry out first resulting in the liquid boiling to partial dryness. Therefore the minimum flow required for complete wetting of a non-circular passage is typically higher than that required for a circular passage. Among non-circular passages, those with fewer corners, e.g. unfinned, are preferred;
3. Properties of the fluid (particularly the surface tension and liquid viscosity) and
4. The contact angle which is a function of the fluid-surface combination; and
5. The method used to distribute liquid into the individual heat transfer passages.

The flowrate per unit width ($\Gamma_L$) is:

$$\Gamma_L = M_L/W$$

where: $M_L$=Liquid mass flowrate, [kg/s] and
W=Total flow width or perimeter of the boiling heat transfer surface, [m].

Equations for predicting the minimum liquid flow required for wetting of a surface are expressed in terms of a liquid film Reynolds number, which is related to $\Gamma_L$ as follows:

$$Re_L = \frac{4\Gamma_L}{\mu_L}$$

where: ΓL is the flowrate per unit width [kg/ms], and $\mu_L$ is the liquid viscosity [NS/m$^2$].

Alternatively, the minimum liquid flowrate to ensure adequate wetting can also be expressed as a dimensionless ratio L/V (liquid to vapor mass flowrate ratio) at the exit of the boiling passages.

The relationship between the liquid to vapor mass flowrate ratio L/V, the Reynolds number $Re_L$ and flow width (or perimeter) of the heat transfer surface W is given by:

$$\frac{L}{V} = \frac{[Re_L]W\mu_L}{4M_v}$$

where: $M_v$ is the vapor mass flowrate, [kgs$^{-1}$] and
W is the wetted perimeter, [m].

For a group of shell-and-tube modules the wetted perimeter is calculated from $$W = N_t N_m \pi\, Di$$

where: $N_t$=number of tubes per module
$N_m$=number of modules
Di=inside diameter of the tubes, [m].

For other geometries W=Number of boiling channels X channel perimeter.

Since adequate wetting of the boiling surfaces is important from safety considerations, a minimum liquid flow must be maintained. Thus, a criteria can be set either in terms of a minimum film Reynolds number ($Re_L$) or minimum exit L/V (liquid to vapor mass flowrate ratio) to operate the main condenser/reboiler safely.

Experimental work has shown that with the practice of the invention one can operate at a lower L/V because of the following: unexpectedly better heat transfer performance requiring less surface area, reduction in wetted perimeter due to lower surface area and longer tube length, and unexpectedly better wettability characteristics of enhanced boiling surfaces.

In summary, the FIGURE shows relevant portions of a system for the cryogenic distillation of air that has the following characteristics:

employs once-through downflow main condenser, either of high flux shell-and-tube type or high flux BAHX type does not employ a recirculation pump to ensure wettability of boiling passages during normal operation not all of the oxygen liquid flowing down the boiling passages is vaporized therefore, liquid flow is present at the exit of the boiling passages at an L/V within the range of from 0.05 to 0.5.

When the cryogenic air separation plant is operated at certain part loads and when the liquid flow down the boiling passages is not sufficient to satisfy the wetting criteria, the product oxygen pump 18 may be used to pump some oxygen liquid to the boiling surface while the remainder of withdrawn oxygen liquid is passed in line 38 for recovery.

Although the invention has been described in detail with reference to certain preferred embodiments those skilled in the art will recognize that there are other embodiments of the invention within the spirit and the scope of the claims.

The invention claimed is:

1. A method for operating a cryogenic air separation plant having a higher pressure column and a lower pressure column comprising passing nitrogen vapor from the higher pressure column to the upper portion of a once-through main condenser, flowing oxygen liquid from the separation section of the lower pressure column to the upper portion of the once-through main condenser without recirculation of sump liquid from the lower pressure column to said upper portion during normal operation of the cryogenic air separation plant, passing the nitrogen vapor and the oxygen liquid down the once-through main condenser in heat exchange relation wherein at least some but not all of the downflowing oxygen liquid is vaporized such that the oxygen liquid and resulting oxygen vapor flows in a co-current direction toward a bottom portion of the once-through main condenser, and withdrawing both the oxygen vapor and oxygen liquid from the once-through main condenser from the bottom portion thereof in a liquid to vapor mass flowrate ratio within the range of from 0.05 to 0.5.

2. The method of claim 1 wherein the liquid to vapor mass flowrate ratio is within the range of from 0.2 to 0.4.

3. The method of claim 1 wherein the once-through main condenser is a shell-and-tube module.

4. The method of claim 1 wherein the once-through main condenser is a brazed aluminum heat exchanger.

5. The method of claim 1 wherein the once-through main condenser comprises a plurality of condenser modules.

6. The method of claim 1 wherein the once-through main condenser has boiling passages with enhanced boiling surfaces.

7. The method of claim 1 wherein the once-through main condenser has boiling passages with high flux boiling surfaces.

* * * * *